US006745913B2

(12) United States Patent
Abraham

(10) Patent No.: US 6,745,913 B2
(45) Date of Patent: Jun. 8, 2004

(54) LIQUID ABSORBENT DRINK CONTAINER DEVICE

(76) Inventor: David M. Abraham, 333 Briarbend Blvd., Powell, OH (US) 43065

( * ) Notice: Subject to any disclaimer, the term of this patent is extended or adjusted under 35 U.S.C. 154(b) by 0 days.

(21) Appl. No.: 10/036,705

(22) Filed: Dec. 21, 2001

(65) Prior Publication Data

US 2003/0116520 A1 Jun. 26, 2003

(51) Int. Cl.[7] ..... A61J 9/08
(52) U.S. Cl. ..... 215/11.6; 2/49.1; 248/102
(58) Field of Search ..... 215/11.6, 11.1; 2/49.1, 49.2; 248/102, 103–106; 606/236

(56) References Cited

U.S. PATENT DOCUMENTS

| | | | | | |
|---|---|---|---|---|---|
| 811,742 | A | * | 2/1906 | Fetrie | 215/392 |
| 1,464,525 | A | * | 8/1923 | Girr | 215/11.6 |
| 2,450,927 | A | * | 10/1948 | Allen | 248/105 |
| 2,475,923 | A | * | 7/1949 | Suich | 248/105 |
| 2,510,953 | A | * | 6/1950 | Brose et al. | 248/102 |
| D211,435 | S | * | 6/1968 | Kausen et al. | D83/8 |
| 3,512,301 | A | * | 5/1970 | Kramer | 446/71 |
| 4,050,600 | A | * | 9/1977 | Jennings | 215/11.1 |
| 4,074,721 | A | * | 2/1978 | Smits et al. | 604/366 |
| 4,473,907 | A | | 10/1984 | Maillard | |
| 4,984,697 | A | * | 1/1991 | Kelly | 215/11.1 |
| 5,022,616 | A | * | 6/1991 | Kordecki | 248/106 |
| D325,460 | S | * | 4/1992 | Cameron | D2/227 |
| 5,184,796 | A | * | 2/1993 | Maher | 248/104 |
| 5,765,225 | A | | 6/1998 | Goeckeritz et al. | |
| 5,820,084 | A | * | 10/1998 | Trumbauer et al. | 248/102 |
| D406,349 | S | * | 3/1999 | Hammond | D24/197 |
| 5,898,940 | A | | 5/1999 | Cameron | |
| 6,055,667 | A | * | 5/2000 | Jimenez | 2/49.1 |
| 6,098,934 | A | * | 8/2000 | Skelton | 248/102 |
| D432,759 | S | * | 10/2000 | Krolczyk et al. | D2/864 |
| D451,760 | S | * | 12/2001 | Fox | D7/510 |
| D460,560 | S | * | 7/2002 | Chomik et al. | D24/197 |

* cited by examiner

*Primary Examiner*—Lien Ngo
(74) *Attorney, Agent, or Firm*—Jason H. Foster; Kremblas, Foster, Phillips & Pollick

(57) ABSTRACT

A device for a baby bottle has an absorbent panel attached to a collar. The collar removably mounts in a surrounding engagement to a cap of the bottle and can be absorbent for enhancing the total absorbing capacity of the device. The panel extends from the collar toward a mouthpiece of the bottle, for gently compressing against a baby's chin when the baby is suckling from the bottle. After feeding, the panel and the collar wipe clean the baby's mouth region and are washable for reuse.

11 Claims, 5 Drawing Sheets

LIQUID ABSORBENT DRINK CONTAINER DEVICE

BACKGROUND OF THE INVENTION

1. Field of the Invention

This invention relates generally to infant accessories, and more particularly, to absorbent devices for mounting near a mouthpiece of a baby bottle.

2. Description of the Related Art

When drinking from a bottle or capped cup, infants and young children often allow significant amounts of liquid unintentionally to leak or spill past their lips. This can result in waste, soiling of clothing, chapping of skin and even hygiene problems at the folds of infants' necks.

A number of absorbent bibs are designed to surround nursing bottles in a structurally supportive fashion to prevent soiling of clothing. For example, U.S. Pat. No. 4,473,907 issued to Maillard shows an infant bib that can hold a baby bottle. The bib has a portion covering a chest area of the infant and an enclosure for the bottle, which is insulated to maintain a bottle temperature. In a disposable embodiment, the bib and enclosure include an absorbent material resembling diaper material, which can contain outer porous sheets. The bib is designed to permit the infant to feed itself.

U.S. Pat. No. 5,898,940 issued to Cameron shows a combined baby bib and bottle for infants. A cloth has a neck hole and an attached bottle holder capable of holding all sizes of bottles for feeding a baby. A panel may be formed of absorbent materials, such as broadcloth, blended fabric or other soft material retained in an interior cavity as an absorbing agent. The bottle holder is formed of a stretchable material such as elastic, which firmly holds the bottle for consumption by the baby without requiring the support by another.

U.S. Pat. No. 5,765,225 issued to Goeckeritz et al. shows a holder for a baby bottle which positions the bottle in close proximity to an infant's mouth. The bottle holder is attached to a bib, and has straps to form a harness that holds the bottle. Using the harness, the bottle can be stabilized in a predetermined position on a reclined baby that may be moving its arms and legs.

It is also well known to wrap an absorbent cloth, such as a napkin, around a neck of a bottle after pouring a liquid from the bottle. For example, a cloth napkin is often wrapped around a neck of an open bottle of champagne for absorbing excess liquid.

It would be an improvement to the art of absorbent drinking accessories to have an absorbent device designed for positioning in closer proximity to the child's mouth than the absorbent bottle-holding bibs of the inventions cited above. The device should prevent a child from dribbling liquid down his chin, into the creases of his neck and onto his clothing.

BRIEF SUMMARY OF THE INVENTION

The invention comprises a unique absorbent device that mounts to a baby bottle or other drink container for compressing against a baby's, child's or other user's chin and for wiping the mouth. The device has a collar for mounting to a neck of the bottle. An absorbent panel is attached to the collar, and extends from the collar toward a mouthpiece of the bottle or cup.

The panel is preferably a soft absorbent material, and the collar is a sheath of material surrounding a compressible material. The collar extends around the neck of the bottle or other drink container, and the panel extends around the collar at least the width of the baby's chin. In a preferred embodiment, the panel has opposing edges tapered downwardly to the collar.

Figures 1, 2, 3:
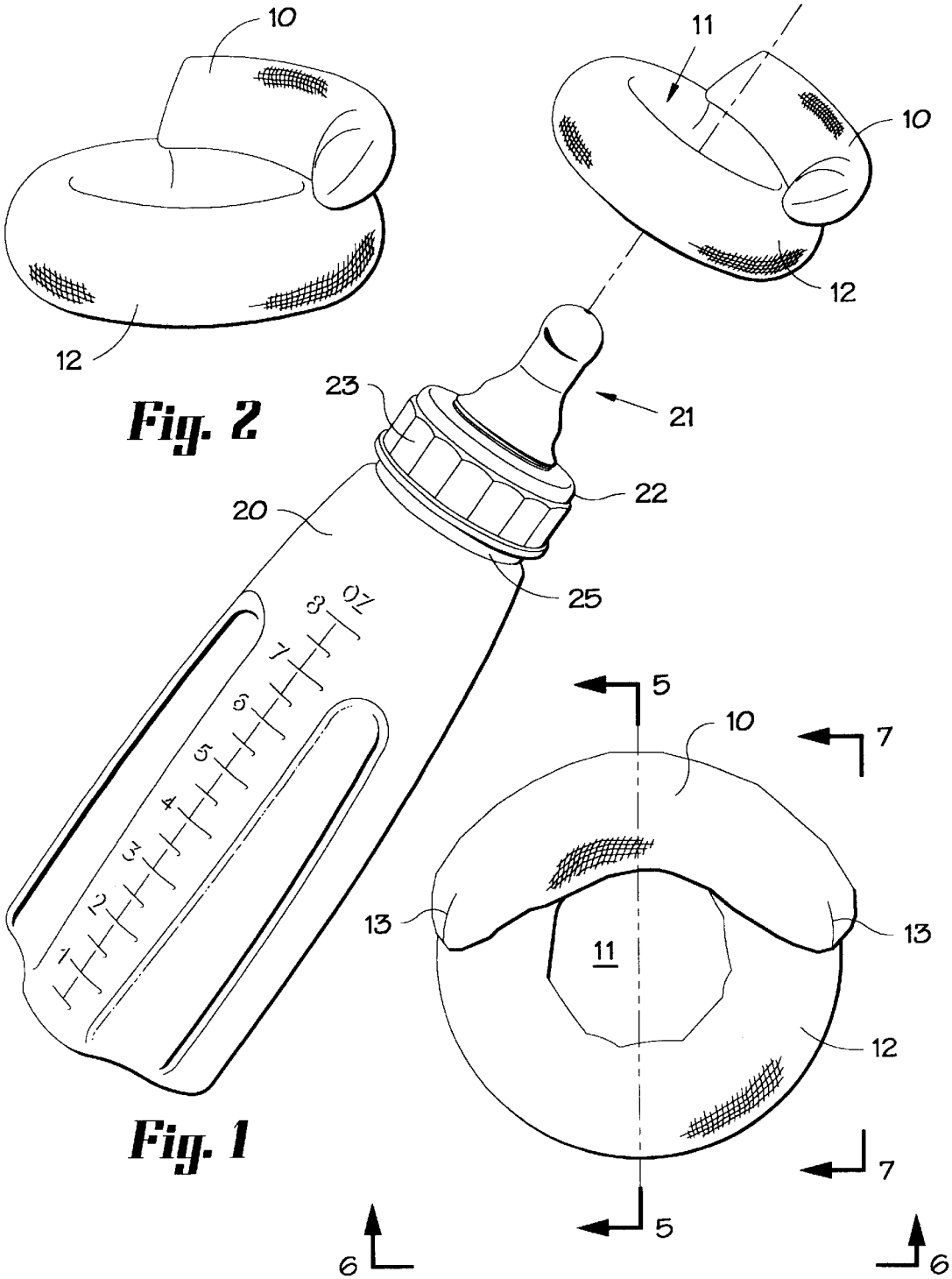
FIG. 1 is a side view illustrating a baby bottle aligned with the preferred embodiment of the invention.
FIG. 2 is a perspective view illustrating the invention.
FIG. 3 is a top view illustrating the invention.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose. For example, the word connected or term similar thereto are often used. They are not limited to direct connection, but include connection through other elements where such connection is recognized as being equivalent by those skilled in the art.

DETAILED DESCRIPTION OF THE INVENTION

Figure 8:
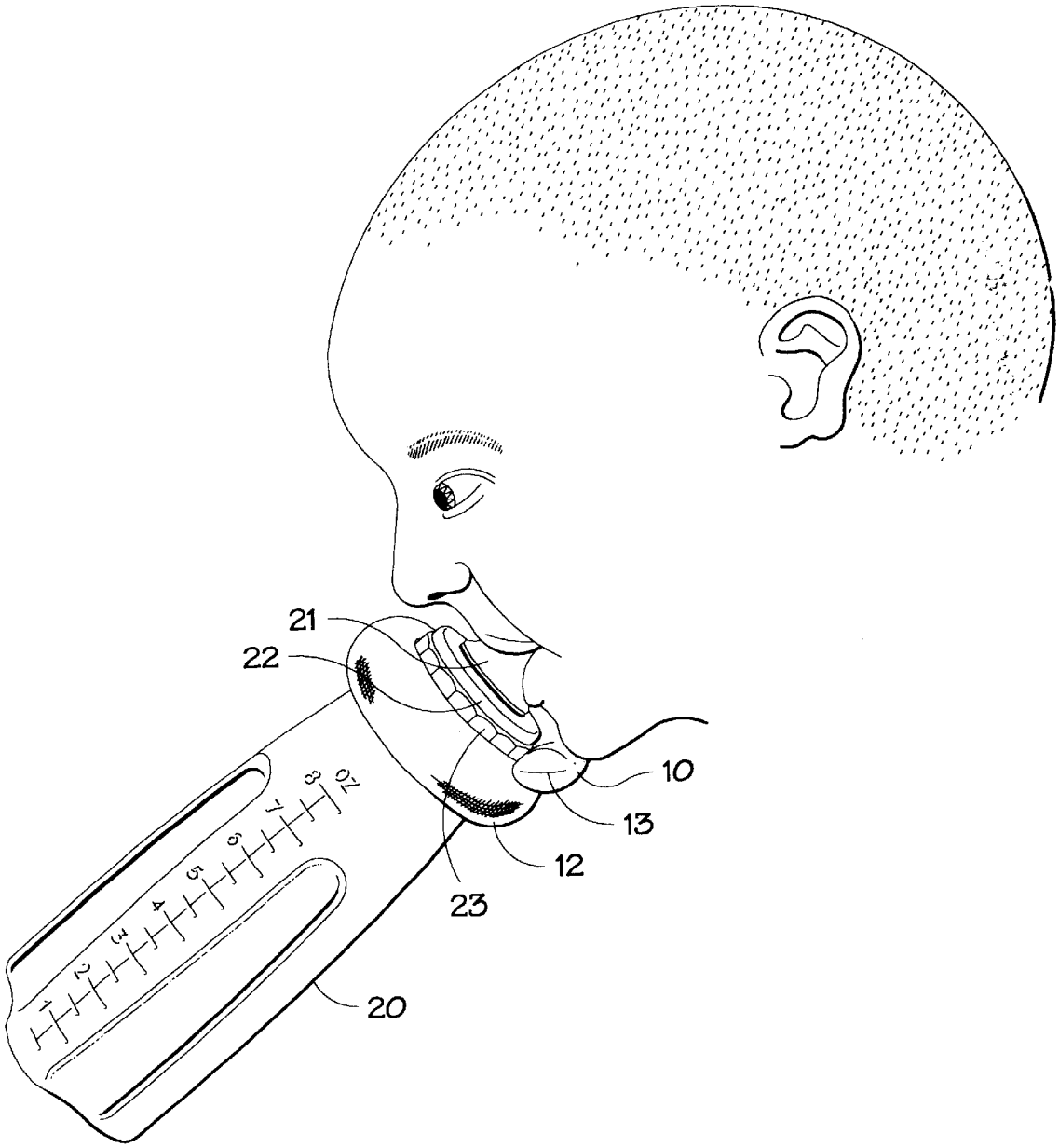
FIG. 8 is a side view illustrating the invention in use.

The preferred embodiment of the invention is shown in FIGS. 1 through 8 as a device having an absorbent panel 10 fixed to a collar 12. The collar 12 attaches at a neck 25 of a conventional baby bottle 20, and the panel 10 extends away from the bottle 20. When a baby is feeding from the bottle 20, the panel 10 contacts the baby's chin beneath the lower lip, as shown in FIG. 8. For illustrative purposes, the conventional baby bottle 20 is shown and described. However, one possessing ordinary skill in the art will recognize that the invention described below is useful for mounting to any other container having a mouthpiece, such as a sipper cup for toddlers (not shown) or a geriatric or other drinking container.

Figure 4:
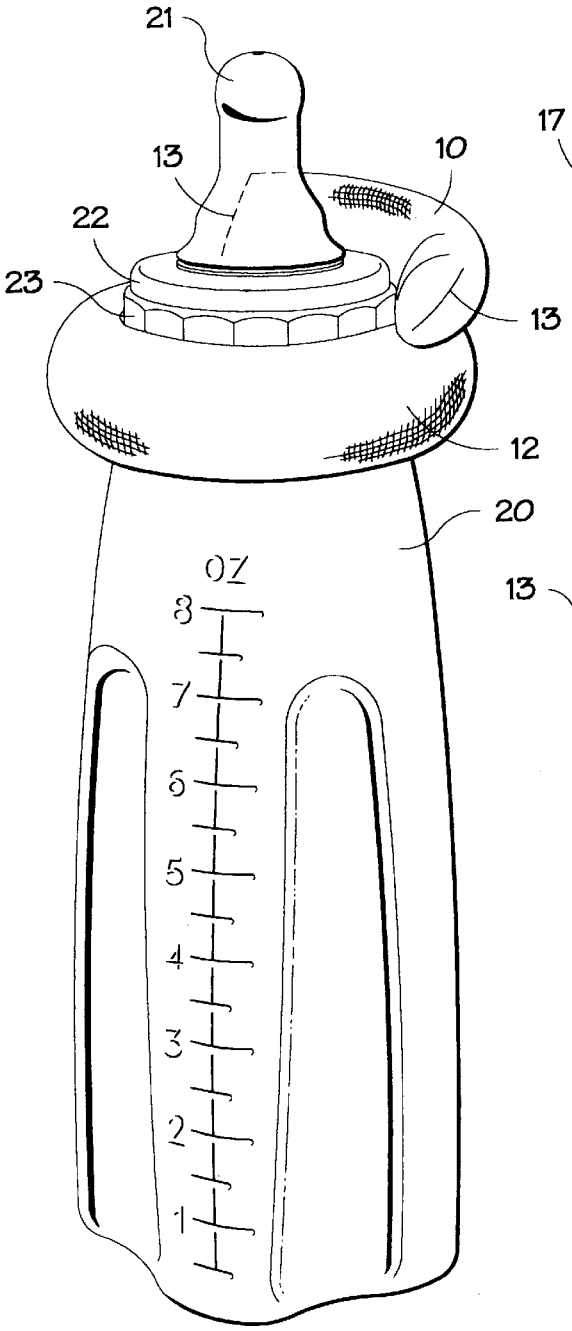
FIG. 4 is a view illustrating the invention mounted to the baby bottle.

A suitable example of the baby bottle 20 for such purposes is shown in FIGS. 1, 4 and 8. The bottle 20 has a nipple-shaped mouthpiece 21 fixed to a rigid cap 22 that is removably mounted to the bottle 20. The mouthpiece 21 extends a predetermined distance above the cap 22 to fit the inside of an infant's mouth. The cap 22 is formed with a plurality of gripping ridges 23 that facilitate grasping, rotating and removing the cap 22 for refilling and cleaning the bottle 20. The neck 25 of the bottle 20 is usually narrower than a region of the bottle 20 below the neck 25.

Figure 5:
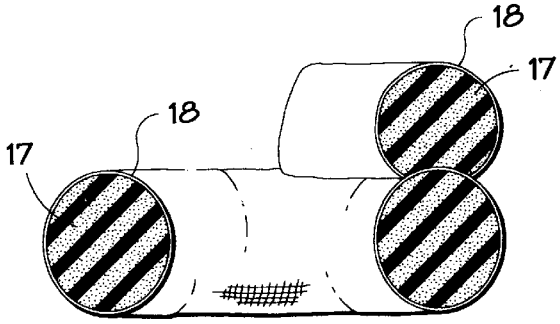
FIG. 5 is a sectional view illustrating the invention along line 5—5 in FIG. 3.
Figure 6:
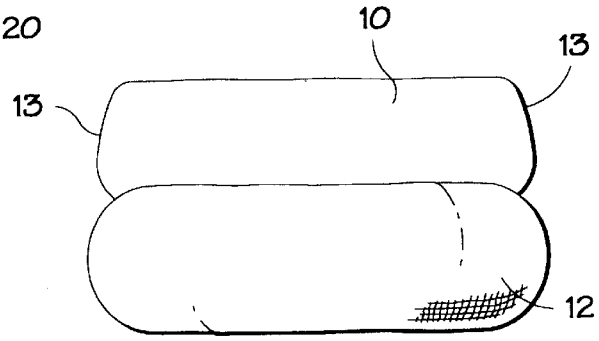
FIG. 6 is a side view illustrating the invention along line 6—6 in FIG. 3.
Figure 7:
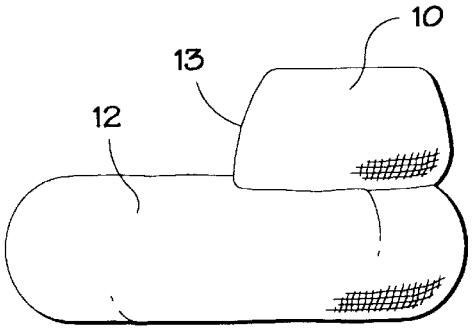
FIG. 7 is a side view illustrating the invention along line 7—7 in FIG. 3.

The preferred collar 12 is a unitary, annular structure formed to be slightly smaller in inner diameter than the neck of a standard baby bottle 20 shown in FIG. 1. (Of course, a collar designed for a sipper cup or other container could be a different size.) The preferred collar 12 has an opening 11. As shown in FIG. 5, the preferred collar 12 resembles the panel 10 in its cross sectional construction, having a sheath 18 enclosing an absorbent material 17. By adding the absorbent material 17 in the collar 12, the performance of the invention in enhanced, because the available absorbing surface area for wiping the baby's face is increased to include the entire collar 12.

The collar 12 serves to mount the panel 10 to the bottle 20 or other container. In the preferred embodiment, the collar 12 is stretched and slipped around the cap 22, gripping the cap 22 when released from the stretched position. Also, the collar 12 can be mounted onto the bottle 20 using one hand. In this process, the opening 11 of the collar 12 is aligned above the mouthpiece 21 of the bottle 20, as shown in FIG. 1, and the bottle 20 is inserted therethrough, so that the inside of the collar 12 contacts the gripping surfaces 23 of the cap 22 and the narrowed region of the bottle 20 beneath the cap 22, which is the neck 25. When pushed downward onto the cap 22, the collar 12 does not displace the rigid cap 22. Instead, the downward force expands the collar 12 radially outwardly thus permitting the collar 12 to move downwardly around the cap 22. The collar 12 thus becomes mounted to the cap 22 by the gripping force acting against the cap 22 and the neck 25 of the bottle 20.

As shown in FIGS. 2 and 3, the panel 10 extends circumferentially about one-third to one-half of the distance around the collar 12. The panel 10 preferably extends at least about the width of the chin of a baby or other person using the invention. As shown in FIGS. 3 and 5, the preferred cushioned panel 10 is elongated, cylindrical in cross section and tapered at its opposite ends 13. The pair of opposing ends 13 angle toward the collar 12, thereby imparting the tapered form to the panel 10. The panel 10 is anchored tightly against the collar 12 preferably by being stitched against the collar 12 along its length where the panel 10 seats against the collar 12. In this way, the panel 10 is stabilized in an upright position with respect to the collar 12. The anchored side holds the panel 10 substantially immobile, so the panel 10 is always aligned to contact the chin of the baby when the bottle's or cup's mouthpiece 21 is inserted into the baby's mouth. The tapered ends 13 are preferred to reduce the probability that the panel 10 will flip downwardly and away from the mouthpiece 21. If flipped downwardly and away from the mouthpiece 21, then the panel 10 exposes the cap 22, which can contact the baby's chin.

As shown in FIG. 5, the preferred structure for the panel 10 is the absorbent core material 17 surrounded by the covering, absorbent sheath 18. The sheath 18 is composed of a soft fabric such as cotton, flannel, or terrycloth. The resulting panel 10 is soft, because the materials 17 and 18 are soft, yet structurally arranged to impart the necessary firmness to the panel 10. The fabric composing the sheath 18 can have printing designs that are pleasing aesthetically to the baby or the parent.

The absorbent material 17 is of a sort commonly used in health care settings. For example, the absorbent material 17 can be composed of a fabric woven together, such as terrycloth, or the quilted material composing a typical cloth diaper. The material 17 should be a one-way or unidirectional absorber, which means it has a high capacity to hold the liquid that has been absorbed due, for example, to molecular attraction to the liquid. The material 17 should absorb substantially every drip from the cap 22 and the mouthpiece 21 that occurs during feeding, and still have a capacity to absorb more when the panel 10 is used to wipe the baby's face after feeding.

When a baby is fed with a conventional bottle 20, the mouthpiece 21 is inserted into the baby's mouth, and a gap is defined, between the cap 22 at one side and the baby's chin at another side. The panel 10 is of a shape and size that is slightly larger than that gap, so that the panel 10 occupies the gap and compresses between the baby's chin and the collar 12, when the mouthpiece 21 is in the baby's mouth as shown in FIG. 8.

The panel 10 is designed to be soft, so the baby experiences no discomfort when the panel 10 contacts the chin, but relatively firm so the weight of the bottle 20 does not completely compress the panel 10. The structural arrangement of the panel 10 is advantageous, because caregivers often inadvertently hold bottles at imprecise angles when feeding babies. In instances when the invention is not used, the plastic bottle cap can be brought into contact with the baby's delicate chin. With the present invention in place, the cushioned panel 10 extends in the same direction as the mouthpiece to a fraction, for example about half, of the length of the mouthpiece 21. Thus, once the mouthpiece 21 is inserted almost completely into the baby's mouth for feeding, the panel 10 seats against the baby's chin. As the mouthpiece 21 is further inserted into the baby's mouth a small distance, the cushioned panel 10 softly compresses against the baby's chin to prevent contact with the hard cap 22. If the baby is allowed to hold the bottle 20 itself, with adult supervision, then the panel 10 resting against the baby's chin supports and cushions the weight of the bottle 20. Without the cushioned panel 10, the rigid cap 22 of the bottle 20 would rest against the baby's delicate chin.

The absorbent material 17 is preferably of a type capable of withstanding repetitive cycles in a common washing machine. In this way, the panel 10 is reusable. Of course, the panel 10 could be made of disposable material, such as the material of which disposable diapers or nursing pads are made. Regardless of the type, the material 17 should absorb and hold excess liquids from the feedings that are administered throughout a typical day of caring for the baby, during which the panel 10 can become saturated with the liquid. Of course, even if the device is reusable, the caregiver may wish to dispose of it rather than retaining it.

The invention is easily removed from the bottle 20 and discarded without a risk of the liquid leaking from the absorbent material 17. Substantially no liquid escapes from the panel 10 when pressure is applied to release the saturated device from the neck 25 of the bottle 20. Thus, the invention promotes the cleanliness of the baby's immediate surroundings and minimizes a risk of stains to clothing and surfaces.

The panel 10 and the collar 12 are also designed for wiping the liquid from around the baby's mouth. All sides of the panel 10 and the collar 12 are designed to wipe, in napkin-like fashion, the baby's face and neck after being fed and after the mouthpiece 21 has been removed from the baby's mouth. The removal of the mouthpiece 21 and wiping action can almost be performed as a continuous motion, using the hand holding the bottle 20 and leaving the device in place on the bottle 20. Additionally or alternatively, a panel and a collar could include a mild soap or similar cleansing agent to enhance the cleaning performance of the invention (not shown).

The collar 12 is also designed to keep the bottle 20 clean by the collar 12 absorbing liquid that contacts it. The collar 12 fits around the neck 25 to cover the gripping surfaces 23 of the cap 22, as shown in FIG. 4, and any liquid that leaks through the cap 22 is absorbed. Furthermore, once the collar 12 is secured around the neck 25, the collar 12 cannot inadvertently shift downward along the bottle 20, even when the device is saturated with liquid. Even on a bottle with a substantially constant circumference along its length and no distinguishable neck, the gripping force of the collar 12 against such a bottle still suffices to prevent the collar 12 from inadvertently shifting downwardly or upwardly and off the bottle. Also, a baby or child cannot remove the collar 12 from the bottle 20.

In an alternative embodiment, a collar can be a non-unitary piece having a cooperating means for securing the collar to the bottle 20 (not shown). The means can be straps that surround the bottle and fasten together with snaps, elastic, hooks and loops (e.g., Velcro brand) and similar commercially available fasteners. In all embodiments, the collar is mounted sufficiently secure to prohibit the baby or other user from removing the collar. Once attached, the collar should remain substantially immobile on the bottle 20 until deliberately removed by an adult.

Various other alternative embodiments exist for the collar 12. For example, one contemplated alternative collar is an elastic band fixed to a panel by stitching or glue (not shown). Such a collar has less absorptive qualities, but may be less expensive to manufacture. Another alternative collar is a bendable wire band that does not extend entirely around the neck 25 of the bottle 20 (not shown). The wire band is sheathed in a padded, absorbent material and looks substantially like the collar 12 of the preferred embodiment. The wire collar is mounted to the bottle 20 by bending the band to firmly, clampingly grip the neck 25 of the bottle 20. The collar would be removed from the bottle 20 by bending the band in the reverse direction.

Also, another alternative collar is a clamp that is biased for holding onto the neck 25 of the bottle 20 (not shown). Similar equivalent attachment means that results in the panel 10 being mounted in the described position relative to the mouthpiece 21 of the bottle 20 are contemplated as falling within the bounds of the invention.

As an alternative embodiment, a bib panel is removable from a collar (not shown). The panel has a front side that is absorbent. An opposing rear side has an attachment fastener that receives a cooperating attachment fastener on a collar. The fasteners may be snaps or similar attachment means, such as interconnecting loops and hooks.

Alternatively or additionally, to further enhance the liquid-retaining capabilities of the invention, a panel can be enveloped in a cover having one or a plurality of unidirectional pores (not shown). The pores can be a type to permit flow of a liquid only into the panel for absorption, but to prevent leakage out of the panel.

It is contemplated that the dimensions of the device can be altered by changing the size and shape of the elements of the invention, for substantially similar applications on drinking containers with various configurations, such as sipper cups and cups for the elderly or anyone who might spill a liquid drink. The holder of the container can simply wipe the bib against the parts of the body that get wet for absorbing any drops of the liquid. The wiping preferably occurs immediately after pouring, to prohibit the liquid from streaking on the body. The bib panel is formed to be proximate to a spout and lip of the container, so that the panel is positioned for wiping and absorbing the liquid immediately after pouring.

Figure 9:
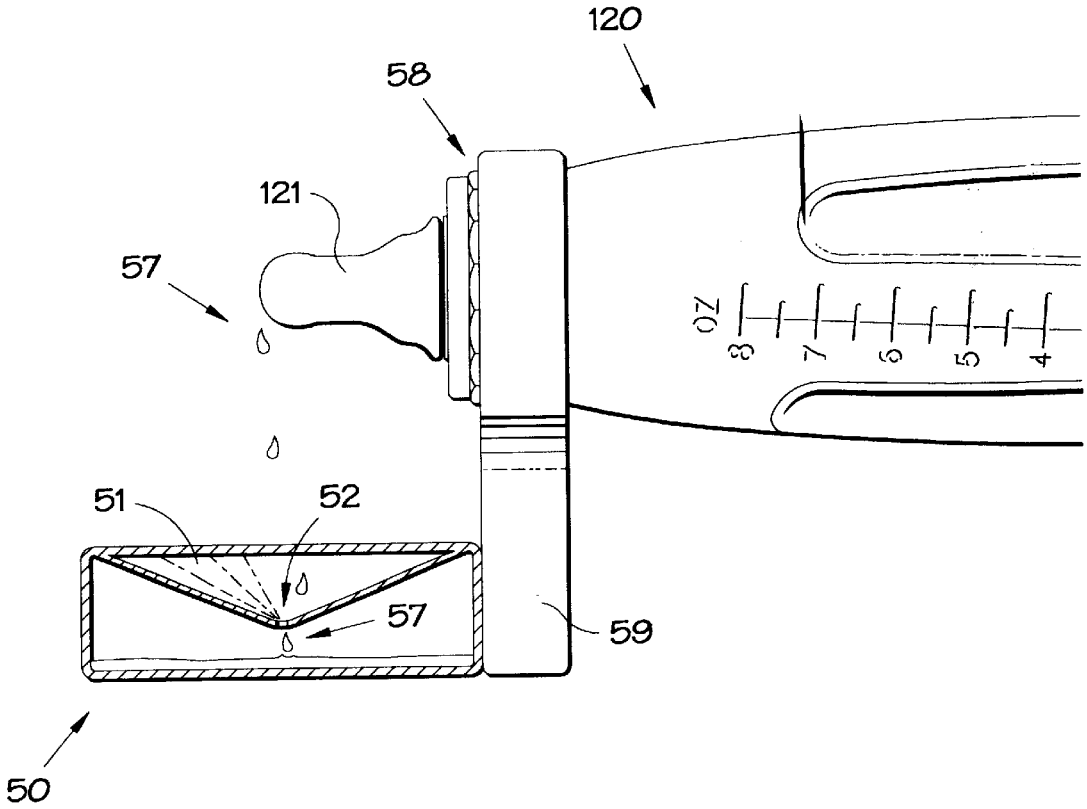
FIG. 9 is a side view illustrating an alternative embodiment.

In another alternative embodiment shown in FIG. 9, a liquid-trapping basin 50 has a collar 59. The collar 59 extends around a neck 58 of a bottle 120, for mounting the basin 50 in proximity to a mouthpiece 121 of the bottle 120. The basin 50 has a top surface 51 and an opening 52, which permits flow of the liquid 57 only into the basin 50. The opening 52 leads into the basin 50 and prevents leakage.

The top surface 51 is contoured for channeling a liquid 57 through the opening 52. As a user (not shown) drinks through the mouthpiece 121, some of the liquid 57 may drip from the bottle 120 at the user's mouth. The liquid 57 will drip downwardly into contact with the top surface 51, which is angled toward the opening 52. The liquid 57 flows through the opening 52 and collects within the basin 50. The top surface 51 can be removed for emptying and cleaning the basin 50.

Figure 10:
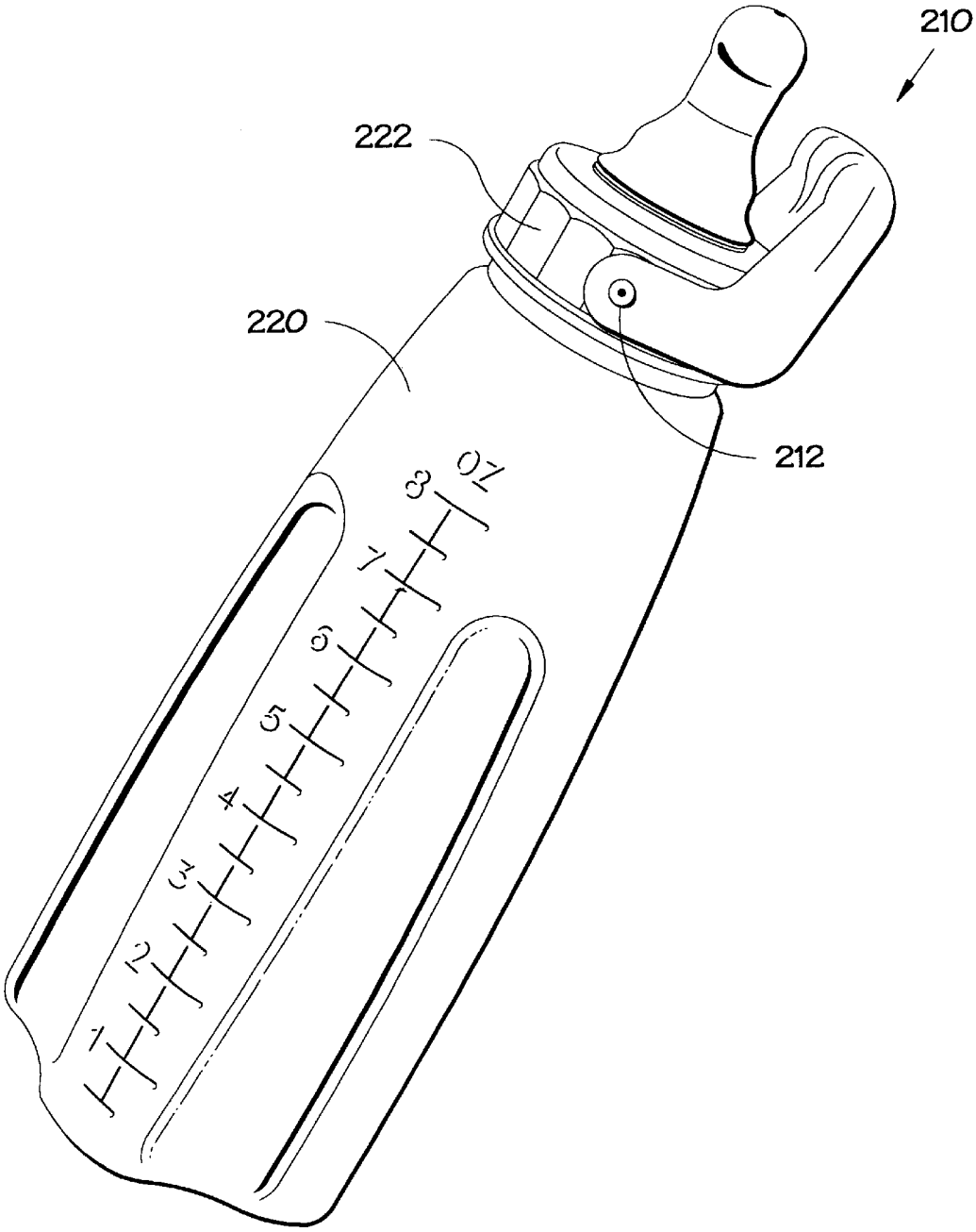
FIG. 10 is a side view illustrating an alternative embodiment.

In still another alternative embodiment shown in FIG. 10, a panel 210 is mounted to a bottle 220. The panel 210 is shown substantially permanently mounted to a cap 222 of the bottle 220, although the panel 210 may be mounted to another region of the bottle 220 such as the neck. The panel 210 is shown mounted to the bottle 220 by rivets 212, although it will become apparent that alternative attachment means may be used, such as a screw or a waterproof adhesive (not shown). The bottle 220 with attached panel 210 could be disposable or reusable, and it can be constructed for washing in a dishwasher or a washing machine, for example.

While certain preferred embodiments of the present invention have been disclosed in detail, it is to be understood that various modifications may be adopted without departing from the spirit of the invention or scope of the following claims.

What is claimed is:

1. A liquid absorbent device mounted to an elongated drinking container having a cap and a mouthpiece that is aligned substantially parallel to the container, and is adapted to be inserted into a user's mouth, the drinking container also having a radial surface at a base of the mouthpiece, the device comprising:

(a) a collar mounted to the cap of the container; and (b) an absorbent, compressible panel extending longitudinally from the collar in the direction of the mouthpiece past the radial surface and terminating between a mouthpiece tip and the radial surface, said panel for being compressed between the collar and the user's chin, said panel extending at least the width of the user's chin.

2. The device in accordance with claim 1, wherein the collar extends entirely around a neck of the container.

3. The device in accordance with claim 2, wherein the collar is absorbent.

4. The device in accordance with claim 2, wherein the panel extends around less than about half of a circumference of the collar.

5. The device in accordance with claim 4, wherein the panel has a pair of opposing ends, and the ends are tapered toward the collar.

6. The device in accordance with claim 4, wherein the panel has a sheath.

7. The device in accordance with claim 6, wherein the sheath is a stretchable fabric having a plurality of pores.

8. The device in accordance with claim 1, wherein the collar extends a majority of the distance around the neck of the container.

9. The device in accordance with claim 8, wherein an absorbent material envelops the collar.

10. The device in accordance with claim 1, wherein the collar includes means for removably attaching the collar to the container.

11. The device in accordance with claim 1, wherein the container is a baby bottle.

* * * * *